United States Patent [19]

Properzi

[11] 4,109,879

[45] Aug. 29, 1978

[54] METHOD AND APPARATUS FOR COLLECTING WIRE ROD OR THE LIKE AT THE OUTLET OF A ROLLING MILL

[76] Inventor: Giulio Properzi, Via Pietro Cossa, 1, Milano, Italy

[21] Appl. No.: 781,384

[22] Filed: Mar. 25, 1977

[30] Foreign Application Priority Data

Mar. 26, 1976 [IT] Italy ..... 21611 A/76

[51] Int. Cl.[2] ..... B21C 47/00

[52] U.S. Cl. ..... 242/82; 242/83

[58] Field of Search ..... 242/82, 83; 19/159; 28/21

[56] References Cited

U.S. PATENT DOCUMENTS

| | | | |
|---|---|---|---|
| 2,849,195 | 8/1958 | Richardson | 242/83 |
| 2,857,116 | 10/1958 | Krafft | 242/83 |
| 2,929,576 | 3/1960 | Henning | 242/82 |
| 3,270,978 | 9/1966 | Whitacre | 242/82 |
| 3,395,560 | 8/1968 | Cofer | 242/83 X |
| 3,666,196 | 5/1972 | Fullers | 242/82 |
| 3,822,045 | 7/1974 | Johnson | 242/83 |

*Primary Examiner*—Edward J. McCarthy

*Attorney, Agent, or Firm*—Guido Modiano; Albert Josif

[57] ABSTRACT

Method of collecting wire rod and the like at the outlet of a rolling mill, comprising a step of wire rod depositing in substantially horizontal coils or turns by means of a rotating guide. The wire rod existing the rotating guide is deposited at a variable rotating speed. The rotating speed is controllably variable between two limit values, such as to obtain continuously concentrical coils having a radius continuously and progressively variable between a maximum value and a minimum value, preferably alternatively occurring.

3 Claims, 5 Drawing Figures

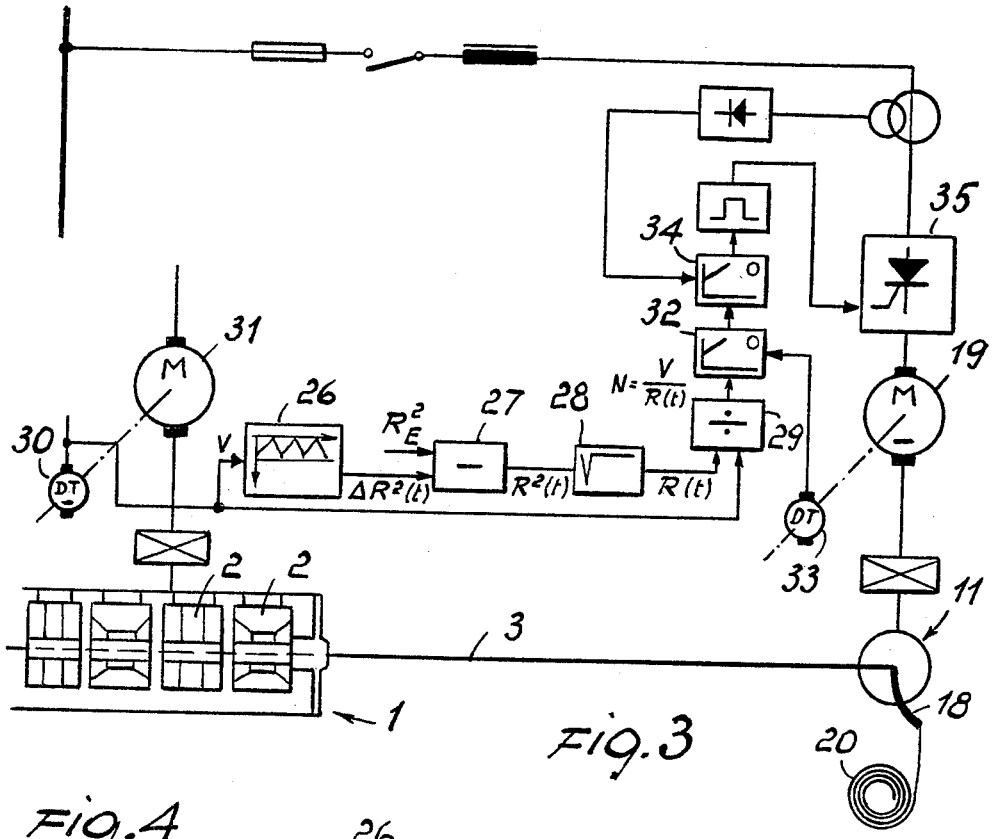
Fig. 3
Fig. 4
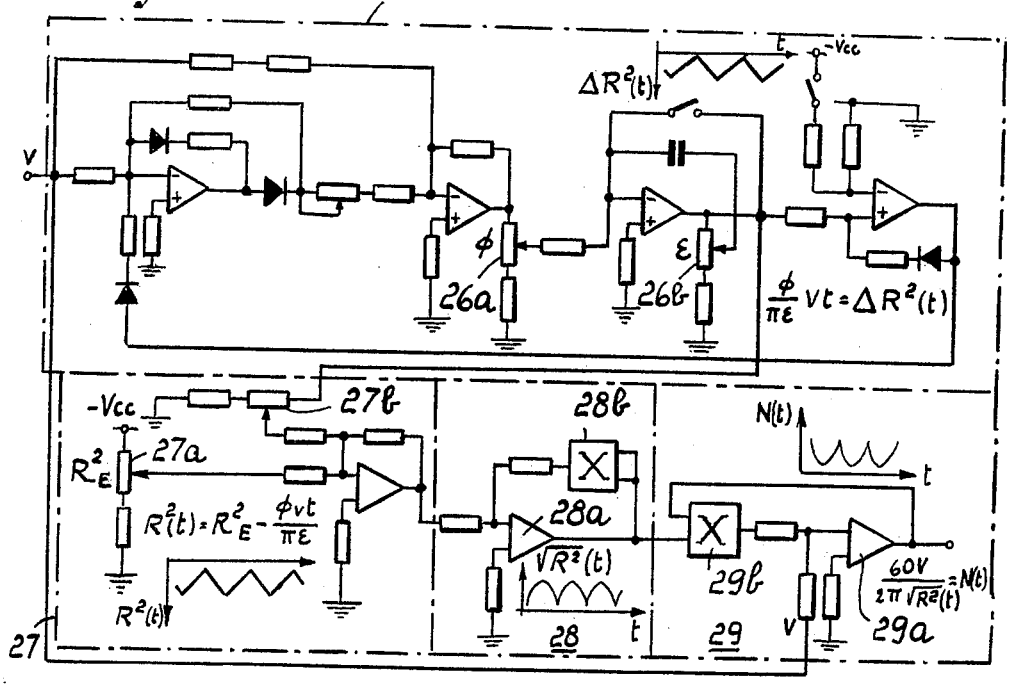

METHOD AND APPARATUS FOR COLLECTING WIRE ROD OR THE LIKE AT THE OUTLET OF A ROLLING MILL

BACKGROUND OF THE INVENTION

This invention relates to a method and apparatus for collecting wire rod or the like at the outlet of a rolling mill, particularly of a continuous operating rolling mill.

For collecting wire rod or the like, various methods and apparata are known in the art. In one of the prior art systems, the wire rod coming out of the rolling mill is first directed upwards through a tubular guide, and then deflected downwards through that same guide, the termination end whereof is placed above a large collecting basket, usually of metal construction, having a diameter of about two meters.

The wire rod exiting the termination end of the tubular guide, and directed downwards, touches the bottom of the basket and, owing to the reaction acting upon it, is caused to deviate arcuately and form coils the diameter whereof is directly proportional, as a coarse approximation, to the height of the guide termination end from the basket bottom.

The guide is hinged to the end closest to the rolling mill along a horizontal axis, such that its termination end may be raised and lowered with respect to the bottom of the basket, whereby the diameter of the coils formed may be very coarsely varied. The raising and lowering are effected by a specially appointed operator, who monitors the arrangement of the coils and brings the guide, for example, first to a position farther away from the basket to form larger coils, and then moves the termination end closer to the basket in order to form smaller coils, thereby first the periphery and then the center of the basket are filled.

Also known are apparata of this type, wherein the guide is raised and lowered automatically with intermediary of a motor, as disclosed in the U.S. Pat. No. 3,395,560.

It becomes possible, with this system, to prepare basketfuls of wire rod weighing half a ton, for aluminum, and above, for heavier metals. The basketfuls thus obtained, however, are bulky and disorderly arranged, because the filling factor is low, and are utilized only when the wire rod is to be further processed on the spot. If on the contrary, the wire rod is to be delivered to outside plants, than an additional coiling step around a reel is required, which is carried out by means of high speed coilers, accounting for increased costs and constructional complexity.

Other collecting systems, of known design, provide for the employment of a rotating curved guide located at the termination of the tubular guide, which in this particular case is stationary. The wire rod is passed to the rotating guide, and owing to the rotational movement of the latter, is deposited in concentrical coils or turns onto an underlying reel. It is known, in an apparatus of this type, to cause the curved guide to first rotate at a given speed, to deposit a given number of coils or turns, and then to rotate at a different speed, to deposit further coils, more to the inside or outside of the previous ones according to whether the new speed is higher or lower than the initial speed.

Here too, rather disorderly arranged skeins are obtained which are unsuitable for transportation and outside delivery, thereby for this purpose a subsequent winding step is still necessary, with the attendant drawbacks mentioned above.

In order to improve the filling factor of the skeins formed with the rotating guide, it has been proposed, moreover, to place the reel whereon the skeins are formed on a rotating table, the rotation axis whereof is off-centered with respect to the rotation axis of the rotating guide. In this manner, by rotating the table, an orbital arrangement of the coils or turns is obtained, thus improving the filling factor, without, however, obtaining as yet compact skeins suitable for shipment.

SUMMARY OF THE INVENTION

It is a primary object of this invention to obviate the drawbacks mentioned above by providing a method and apparatus for collecting wire rod, which afford the formation, at the outlet of a rolling mill, of wire skeins having a high filling factor entanglement free, easy to unroll and directly utilizable for shipment without any further winding.

It is another object of this invention to provide a method and apparatus as specified hereinabove, whereby a skeined wire rod may be obtained having uniform metallic and metallurgic characteristics, all the coils or turns undergoing uniform cooling, and avoiding any structure disuniformity between the wire rod gathered first and that gathered last.

It is a further object of the invention to provide a method and apparatus which are simple and of limited cost, suitable for use either with continuously operating rolling mills or discontinuously operated rolling mills, starting from billets.

These and other objects, such as will be apparent hereinafter, are achieved by a method of collecting wire rod and the like at the outlet of a rolling mill, comprising a step of wire rod depositing in substantially horizontal coils or turns by means of a rotating guide, wherein the wire rod exiting the rotating guide is deposited at a variable rotating speed, the rotating speed being controllably variable between two limit values, such as to obtain continuously concentrical coils or turns having a radius continuously and progressively variable between a maximum value and a minimum value, preferably alternatively occurring.

By depositing the coils or turns at a rotational speed varying continuously, coils or turns in several superimposed horizontal layers are obtained, the coils extending, preferably alternately in a gradually increase direction and a gradually decrease direction, over all the superimposed horizontal layers making up the skein. That is, in contrast to the prior art wherein coils of substantially constant diameter are first superimposed vertically, and then along their width by depositing other series of coils, also superimposed and with a substantially constant diameter but having a diameter different from the previous one, with the method according to this invention the deposition is first carried out along the width, varying progressively the coil diameters, and then vertically, to obtain a neat orderly superimposition of another series of progressively variable diameter coils, and so forth. This procedure allows, on one side an orderly filling of the whole space available, thus obtaining a very high filling factor, very close to unitary, and on the other side the achievement of compact coils or reels directly in a condition suitable for shipment, since the single coils or turns are firmly rested one upon another in several horizontal planes or layers. The coils or reel thus formed, in addition to being entanglement-free, are easy to unroll or decoil, which is of extreme importance for the subsequent processing steps which the wire rod is to undergo.

For the implementation of the inventive method, there is provided an apparatus comprising a rotating guide for the wire rod located at the outlet of a rolling mill and rotating about a substantially vertical axis, the apparatus further comprising control means for controlling the rotational speed of the rotating guide, the control means being adapted to control the rotating guide at a rotational speed continuously varying between a maximum value and a minimum value, preferably alternately.

According to a preferred embodiment of the invention, the rotating guide is driven to rotate by a DC motor, and the rotational speed control means is an electronic control configurated to impart to the DC motor a slight speed variation such as to obtain the laying of a consecutive superimposed, alternately increasing and decreasing, plurality of Archimedean coils or turns.

An apparatus of this type affords the obtainment of skeins having a high filling factor and directly suitable for shipment, for a much limited constructive and economic expense. In fact, no wire rod guide structure is necessary which may be raised and lifted with respect to the gathering basket, but just the provision of a rotating guide carried by a fixed structure and the provision of a means of adjusting the rotational speed of the rotating guide according to a predetermined law. Furthermore, the adjustment is fully automatic and requires no intervention by any operators.

BRIEF DESCRIPTION OF THE DRAWINGS

Further features and advantages of the invention will be more apparent from the dependent claims and the following description of a preferred embodiment of the invention, illustrated in the accompanying drawings, where:

FIG. 3 is a block diagram of an electronic control for driving the rotating guide in conformity with the desired law of variation of the rotational speed;

FIG. 4 shows a more detailed functional diagram of the main blocks employed in the control of FIG. 3.

DESCRIPTION OF THE PREFERRED EMBODIMENTS

Figures 1, 5:
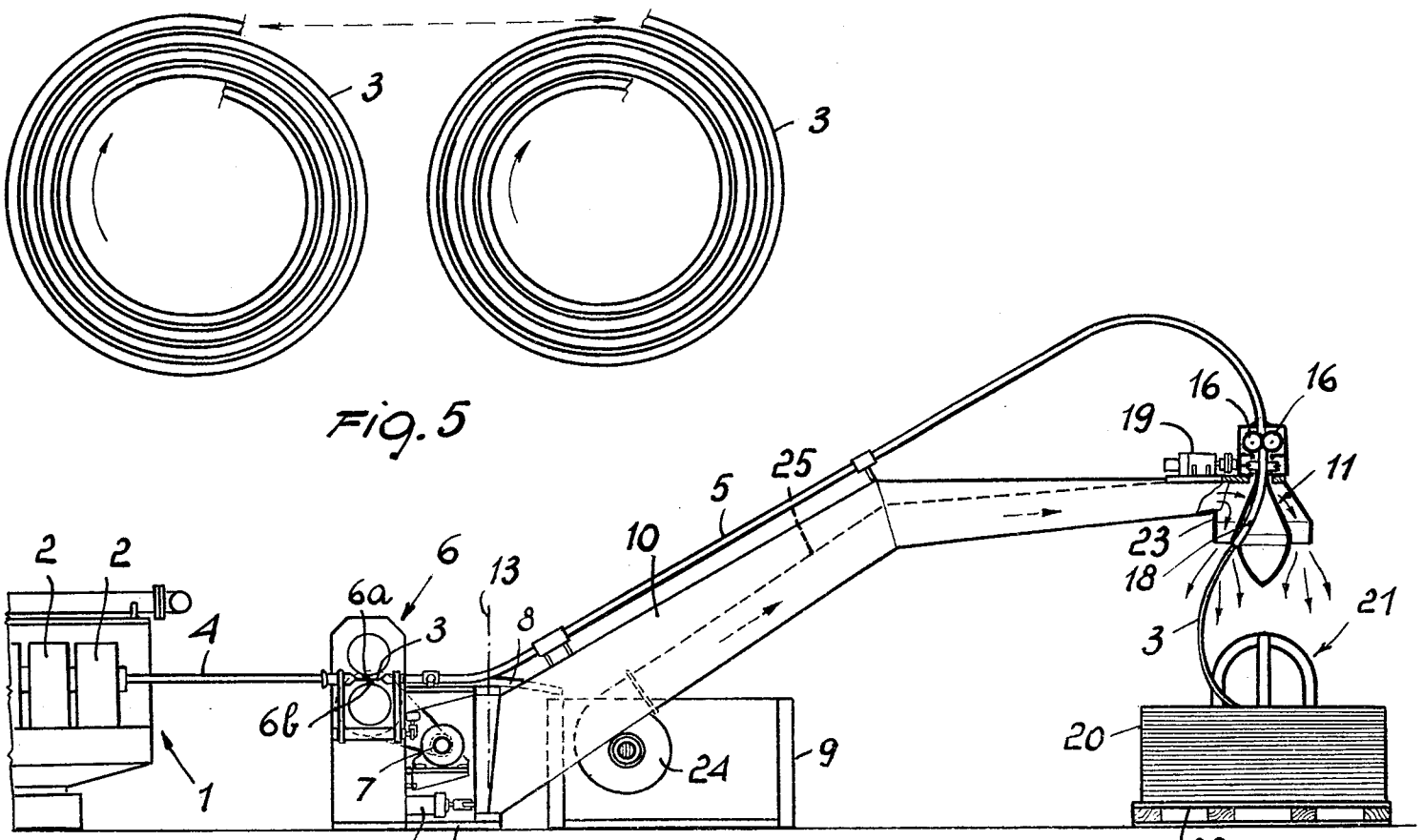
FIG. 1 is a side elevational view of an apparatus according to the invention.
FIG. 5 shows schematically how the coils of two successive layers are deposited in a preferred embodiment, the coils or turns of the two successive layers being represented separately for clarity, although in actual practice they are laid superimposed to each other.
Figure 2:
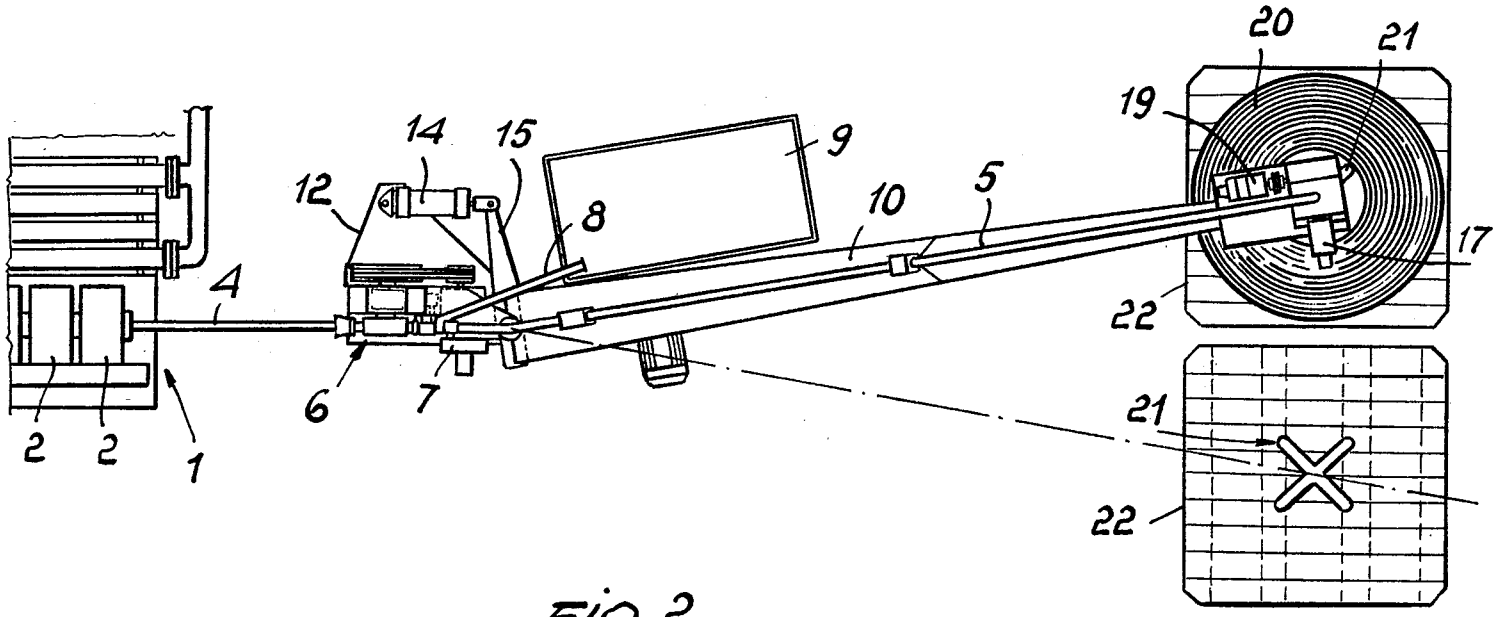
FIG. 2 is a top view of the apparatus depicted in FIG. 1.

In the drawings, the numeral 1 denotes a rolling mill, whereof only the last rolling sets or groups 2 are shown, and at the outlet whereof is arranged a tubular guide for the wire rod 3 having a first horizontal guide length or section 4 and a second guide length or section 5, sloped at first upwards and then curving downwards. Between the two guide sections 4 and 5, a rotative cutter 6 is located which has two rotating blades **6*a* and 6*b* for cutting the wire rod upon completion of a skein formation. The blades are rotated by a motor 7, carried by the housing of the cutter 6**. The cutter is of known design, e.g. as disclosed in the U.S. Pat. No. 3,677,120, so that not all the details thereof will be discussed herein.

At the entry mouth of the guide 5, there is provided the mouth of a discharge guide 8 as well, terminating above a gathering container 9, to which guide 8 the wire rod lengths cut off by the cutter 6 are directed.

The tubular guide 5 is supported by an arm structure 10, carrying at its free end a coil forming rotating head 11, the head being hinged with its other end to a base 12 along a vertical axis 13, thereby it is displaceable between two angular positions corresponding to two discrete gathering positions. For displacing the structure 10, provision is made for a hydraulic cylinder 14, the piston whereof engages with an arm 15 rigid with the structure 10. Understandably, the structure 10 could also be attached to the base 12 with no possibility of angular displacement, in which case there would be but one gathering position.

Between the fixed termination end of the guide tube 5 and rotating head 11, a pair of rollers 16 are arranged, rotatively driven, about fixed axes, by a motor 17 for withdrawing the wire rod 3 left in the guide 5 after the cutter 6 has been operated.

The head 11 carries a curved rotating guide 18 having a wire rod inlet end which is coaxial with the termination end of the guide 5 and the vertical rotation axis of the rotating head 11, and a wire rod laying termination end which is off-centered with respect to the rotation axis of the head 11.

The head 11 (and accordingly the guide 18) is rotatively driven by a motor 19, preferably a DC motor, through a kinematic train whereof only some members are shown in the drawings. The rotation of the rotating guide 18 in combination with the running speed of the wire rod 3 results in the depositing of coils or turns 20 onto a reel 21 provided with a supporting base 22.

Most advantageously, the rotating head 11 is placed inside a case 23 of substantially bell-like configuration, which is spaced from the head 11 such as to create a space for flowing a cooling fluid, e.g. air or water, to the wire rod exiting the rotating guide 18, the fluid being delivered by a blower (or pump) 24 through a passage 25 provided inside the structure 10.

According to the invention, a control means of the motor 19 is provided for varying continuously the rotation speed of the motor, and accordingly of the rotating head 18, between a minimum value and a maximum value, preferably in an alternate mode. In particular, the aim is to deposit the wire rod along a curve the radius whereof is continuously and progressively variable between a maximum and minimum, on a fixed center, such that a general radius of the curve thus obtained intersects the curve at equidistant points from each other. Such a curve is an Archimedean spiral. After depositing a curve of this type, e.g. of decreasing radius, an increasing radius curve is deposited, which orderly overlies the former, and so on, until the skein is completed with several layers of Archimedean spirals, orderly superimposed to one another and alternately, increasing and decreasing. Thus, it is a matter of imparting to the motor 19 predetermined consecutive accelerations and decelerations, for transmission to the rotating guide 18.

In order to find the rotational speed $N(t)$ of the rotating guide 18 versus time, assuming $R$ = general radius of the spiral or turn;

$\Omega = (2\pi N/60)$ angular velocity of the rotating guide;

V = linear exit velocity of the wire rod from the rolling mill; and considering that the law defining Archimede's spiral is $$dR = -Kd\theta$$

(the "−" sign indicating that R must decrease as $\theta$ increases, while $\theta$ denotes the general angle) and that $\Omega = (d\theta/dt)$ and $$R\,\Omega = V$$

then:

$$R\,(d\theta/dt) = V \text{ i.e., } -RdR = KVdt$$

wherefrom, by integration between $R_I$ (inner radius) and $R_E$ (outer radius), and $t_I$ and $t_E$ (corresponding times), the following is obtained:

$$\int_{R_E}^{R_I} -RdR = \int_{t_E}^{t_I} KVdt \quad \text{that is:}$$

$$\tfrac{1}{2}\,(R_I^2 - R_E^2) = -KV\,(t_I - t_E).$$

Substituting for $R_I$ and $t_I$, respectively the instantaneous generic radius R and the generic time $t$, and taking $t_E = 0$, the relation is obtained $$R^2 - R_E^2 = -2KVt \text{ i.e.:}$$

$$R(t) = \sqrt{R_E^2 - 2KVt}$$

representing the variation law of R with time, starting with the outer radius $R_E$. It is easy to arrive from here at N($t$) expressed in rpm, since $$N(t) = \frac{V}{R(t)} \cdot \frac{60}{2\pi} \quad \text{i.e.:}$$

$$N(t) = \frac{V \cdot 60}{2\pi} \cdot \frac{1}{\sqrt{R_E^2 - 2KVt}}$$

Inserting the diameter $\phi$ of the wire rod and the filling factor $\epsilon$ of the layer, and considering that for the equation defining Archimede's spiral $$(\phi/\epsilon) = \Delta R = 2\pi K$$

the following is true, $$R(t) = \sqrt{R_E^2 - \frac{\phi Vt}{\pi\epsilon}} \quad \text{and}$$

$$N(t) = \frac{V \cdot 60}{2\pi} \cdot \frac{1}{\sqrt{R_E^2 - \frac{\phi Vt}{\pi\epsilon}}}$$

This law is implemented by a function generator summarized in the block diagram of FIG. 3 and best detailed out in the functional diagram of FIG. 4. This generator gives the angular velocity reference for the speed regulator of the motor 19 in order to obtain the desired variation with time. In particular, the generator comprises the blocks 26, 27, 28, and 29, which will be next discussed individually.

The block 26 serves to generate with time the linear law of variation of the difference of the square between the outer starting radius $R_E$ and the instantaneous one R($t$), which law is mathematically expressed by the formula $$\Delta R^2(t) = R_E^2 - R^2(t) = \frac{\phi Vt}{\pi\epsilon}$$

Such a law is rendered periodically repetitive by causing the variation $\Delta R^2(t)$, once the maximum value of $R_E^2 - R_I^2$ has been reached starting from zero, to again drop to zero, to then restart towards the maximum value, and so forth.

The block 26 substantially comprises an integrator which, one released, integrates the velocity signal of the wire rod, starting from zero. As soon as the output signal of the integrator reaches a maximum limit equal to $R_E^2 - R_I^2$, the sign is changed of the inlet velocity, by means of an inverter known per se, so that the integrator again tends to zero, and so forth. Said variation $\Delta R^2(t)$ is dependent upon the wire diameter $\phi$, being adjustable through the potentiometer **26*a*, the filling factor $\epsilon$, being adjustable through the potentiometer 26*b*, and the linear velocity V of a first wire rod, which is picked up by the speedometric dynamo 30 (FIG. 3) associated with the motor 31 of the rolling mill and applied to the input of the block 26** after being suitably corrected to correspond to the speed of the last rolling stand. The integration speed is adjustable through the two potentiometers, which vary the integration constant and the amplitude of the speed signal such as to take into account respectively the two variables $\epsilon$ and $\phi$.

The block 27 has the function, starting from the variation law produced by the block 26, of calculating at every instant the square of the radius $R^2(t) = R_E^2 = R_E^2 - \Delta R^2(t)$. It comprises essentially an operational amplifier so connected as to behave as an algebraic adder, specifically of a signal proportional to $R_E^2$ (adjustable through the potentiometer **27*a* during the set up) and a signal, of opposite sign, generated by the block 26 and proportional to $\Delta R^2(t)$ (also adjustable through the potentiometer 27*b*** during the set up, to obtain the desired diameter variation).

The block 28 is operative to calculate, at each instant, the radius, by extracting the square root of the value calculated by the block 27. It is, therefore, a square root generator and comprises an operational amplifier **28*a* having in feedback a multiplier 28*b* with both its inputs in common to the output signal. The thus connected multiplier calculates the square of the output value from the amplifier 28*a*, i.e., $V_M \equiv V_u^2$, it being $V_M$ the output signal from the multiplier 28*b*, $V_u$ the output signal from the operational amplifier 28*a***, $\equiv$ the symbol of proportionality.

Since the operational amplifier **28*a*** requires that the value $V_M$ be proportional to the input value $V_i$ of the amplifier, i.e., $$V_i = V_M \equiv V_u^2, \text{ it is } V_u \equiv \sqrt{V_i}.$$

The block 29 has the function, based upon the exit velocity V of the wire rod and calculated spiral radius R($t$), of generating the angular motion velocity of the motor 19 according to the already calculated law. It comprises essentially a divider formed by a circuit closely similar to that of the block 28, with the difference that the multiplier **29*b* has one input only to the output of the operational amplifer 29*a*, while at the other input to the multiplier 29b the signal appears which acts as a "divider", i.e., $V_D = \sqrt{R^2(t)}$, thereby through a reasoning similar to the instance of the block 28**, it is obtained that $$V_M \equiv V_D \times V_u V_i \equiv V_M \equiv V_D \times V_u V_u = (V_i/V_D)$$

where, $V_M$ is the output signal from the multiplier 29b,
$V_u$ is the output signal from the amplifier 29a,
$V_i$ is the input signal to the amplifier 29a,
$\equiv$ is the symbol denoting proportionality.

The block 29 is followed (FIG. 3) by a comparator block 32, wherein the signal from the block 29 is compared with the signal from a second speedometric dynamo 33, associated with the motor 19, to generate the control signal to the motor 19. The signal from the block 32 is passed to a block 34 which is effective to generate the square wave signal for driving the controlled diode rectifier device 35, wherethrough the DC motor 19 is controlled in a manner known per se.

Thus, with the circuitry just described, it becomes possible to continuously control the rotating guide 18 so as to deposit a plurality of alternately increasing and decreasing Archimedean spirals or turns, according to the diagram of FIG. 5.

Upon completion of the desired number of spirals, the cutter 6 is actuated, which produces wire rod lengths or sections for delivery to the container 9, and which is kept operative until it becomes possible to deposit a fresh wire rod. Concurrently with the above, the motor 17 is energized such that the rollers 16 withdraw the tail end of the wire rod 3 left in the guide 5, this tail or trailing portion forming then the last coils or turns of the completed skein. At this point, the structure 10 is moved to the second gathering position, where a free reel has been previously laid, whereupon the cutter 6 is stopped and the formation of a fresh skein is started in the manner already described hereinabove, while the formed skein is tied and removed. The skein requires no further coiling operation.

It is obviously possible to automate the processing steps, by deriving the start control for such steps from a turn or coil counter calibrated for the desired capacity of each skein.

It should be noted that in the apparatus just described the wire rod is advantageously subjected to uniform cooling throughout its length during the formation of the coils or turns, which results in a wire rod exhibiting excellent mechanical and metallurgical characteristics.

The apparatus according to the invention may also be provided with a wire rod turn seizing and cutting device, as disclosed in the U.S. Application S. N. 773,994 filed Mar. 3, 1977 by the same Applicant, in which case the cutter 6 would be eliminated. Understandably, a means could be provided of preventing the wire rod from being oxidized before the turns or coils are formed, and during the formation of the turns or coils, e.g. with an arrangement as disclosed in U.K. Patent Specification No. 1.417.009 to the same Applicant, in which case the reels would be mechanically displaced through the cooling liquid, and withdrawn from the bath by means of suitable lifting means after the wire rod has been cooled to a temperature whereat it no longer oxidized.

Furthermore, the invention is susceptible to many modifications and variations, all of which fall within the scope of the instant inventive concept. Thus, for example, the coils or turns could be deposited, rather than all uniformly spaced as described, at least in part with a variable density, and this by adjusting the potentiometer 26b, or even the potentiometer 26a, of the multiplier of the block 26. The turns or coils in one layer could also be deposited spaced apart by an interval suitable to accomodate therebetween the turns or coils which are deposited afterwards. Moreover, it is not strictly necessary that the turns or coils be deposited alternately from the outside to the inside, and viceversa, but it is also possible to deposit several superimposed turns or coils starting, for example, always from without to the inside (or from within to the outside), in other words, to provide a slower variation of the rotational speed during the positive deposition step of the turns or coils, and an opposite but much faster variation for returning to the initial conditions of deposition of a fresh equal spiral. Obviously, the expert in the art will recognize the possibility of replacing, without any special difficulties, the DC motor with another type of variable speed motor, while adapting, if necessary, the control circuit to the new type of motor.

I claim:

1. A method of collecting wire rod and the like at the outlet of a rolling mill, wherein the wire rod is deposited in substantially horizontal coils by means of a rotating guide, said rotating guide being rotated at a rotational speed controllably variable between two limit values, such as to obtain continuously concentrical coils having continuously and alternately increasing and decreasing radii variable between a maximum limit value and a minimum limit value, said rotational speed of said rotating guide being controlled to vary between said two limit values according to the law $$N(t) = \frac{V \cdot 60}{2} \cdot \frac{1}{\sqrt{R_E^2 - \frac{\phi V t}{\pi \epsilon}}}$$

periodically repeating, where N is the rotational speed in rpm of said rotating guide, V is the linear velocity of delivery of the wire rod from said rolling mill, $R_E$ is the maximum outside radius of the formed coils, $\phi$ is the diameter of the wire rod, $t$ is the generic time, $\epsilon$ is the filling factor of the coil arrangement.

2. A method according to claim 1, wherein said rotational speed is varied more rapidly during the transition from one of said limit values to the other of said limit values than during transition from said other of said limit values to said one of said limit values.

3. An apparatus for collecting wire rod and the like at the outlet of a rolling mill, comprising a rotating guide for the wire rod located at the outlet of said rolling mill and rotating about a substantially vertical axis for laying the wire rod in coils, a DC motor for rotating said guide, and control means for controlling the rotational speed of said rotating guide to obtain the laying of coils having continuously and alternately increasing and decreasing radii, said control means comprising a first speedometric dynamo associated with said rolling mill to supply a signal related to the linear velocity of the wire rod exiting said rolling mill, a second speedometric dynamo associated with said DC motor of said rotating guide to supply a signal proportional to the rotational speed of said rotating guide, an integrating circuit for said wire rod linear velocity signal, an inverter circuit for feeding said wire rod linear velocity signal to said integrating circuit, an algebraic adder circuit for adding the output signal of said integrating circuit and a signal indicative of the value of the square of the maximum radius of the formed coils, a square root generating circuit for extracting the square root of the output signal supplied by said algebraic adder circuit, a divider circuit for dividing the signal supplied by said first speedometric dynamo by the output signal supplied by said square root generating circuit, a comparator circuit for comparing the output signal of said divider circuit with the signal supplied by said second speedometric dynamo, and a driving device of the controlled diode type for controlling said DC motor.

* * * * *